US005363017A

United States Patent [19]

Garbowicz

[11] Patent Number: 5,363,017

[45] Date of Patent: Nov. 8, 1994

[54] STARTING CAPACITOR DISCONNECT SCHEME FOR A FLUORESCENT LAMP

[75] Inventor: Glenn D. Garbowicz, Rosemont, Ill.

[73] Assignee: North American Philips Corporation, New York, N.Y.

[21] Appl. No.: 14,902

[22] Filed: Feb. 8, 1993

Related U.S. Application Data

[63] Continuation-in-part of Ser. No. 673,692, Mar. 21, 1991, Pat. No. 5,208,511, and a continuation-in-part of Ser. No. 753,280, Aug. 30, 1991, Pat. No. 5,243,258.

[51] Int. Cl.[5] ..... H05B 41/14; H05B 41/36

[52] U.S. Cl. ..... 315/122; 315/125; 315/127; 315/187; 315/240; 315/106

[58] Field of Search ..... 315/DIG. 5, 119, 106, 315/120, 121, 122, 123, 124, 125, 126, 127, 128, 187, 188, 189, 232, 240, 241 R

[56] References Cited

U.S. PATENT DOCUMENTS

| | | | |
|---|---|---|---|
| 4,588,924 | 5/1986 | Luursema | 315/107 |
| 4,645,976 | 2/1987 | Luursema | 315/106 |
| 4,730,147 | 3/1988 | Kroening | 315/100 |
| 4,937,498 | 6/1990 | Bolhuis et al. | 315/106 |
| 4,954,749 | 9/1990 | Crawford | 315/DIG. 5 X |
| 5,208,511 | 5/1993 | Garbowicz | 315/106 |
| 5,243,258 | 9/1993 | Garbowicz | 315/106 |

*Primary Examiner*—David Mis

*Attorney, Agent, or Firm*—Edward Blocker; Bernard Franzblau

[57] ABSTRACT

A starting capacitor disconnect scheme for a fluorescent lamp system in which each starting capacitor shunts one or more series connected fluorescent lamps until all of the fluorescent lamps are ignited. Following ignition of all fluorescent lamps, each starting capacitor is effectively removed from the ballast. Preconditioning of the fluorescent lamp filaments can be limited to the period of time that one or more lamp loads are shunted by the starting capacitor.

22 Claims, 5 Drawing Sheets

STARTING CAPACITOR DISCONNECT SCHEME FOR A FLUORESCENT LAMP

CROSS REFERENCE TO RELATED APPLICATIONS

This is a continuation-in-part of U.S. patent application Ser. No. 673,692, filed Mar. 21, 1991, U.S. Pat. No. 5,208,411 and of U.S. patent application Ser. No. 753,280, filed Aug. 30, 1991, U.S. Pat. No. 5,243,258.

BACKGROUND OF THE INVENTION

This invention relates generally to a fluorescent lamp ballast and, more particularly, to a starting capacitor disconnect scheme for a fluorescent lamp.

A fluorescent lamp ballast for lighting serially connected fluorescent lamps typically employs one or more capacitors (commonly referred to as starting capacitors) for starting purposes. Each starting capacitor is connected across at least one of the serially connected lamps. The voltage produced across the output of the ballast is insufficient to ignite all serially connected lamps at the same time. The starting capacitor acts as a shunt across the one or more lamps that the capacitor is connected in parallel with. A voltage sufficient for ignition of the unshunted lamp then can be applied thereto. Once the unshunted lamp has been ignited, the one or more shunted lamps are then ignited because the voltage produced by the ballast now is sufficient to ignite these one or more shunted lamps.

Current spikes produced by the starting capacitor are considered by lamp manufacturers to adversely affect lamp life through excessive sputtering of emissive electrode material onto the inner walls of the lamp. The sputtered electrode material which covers the inner lamp wall reduces the lumen output. The starting capacitor also redirects a portion of the available current away from the shunted lamps resulting in less light by the latter.

Accordingly, it is desirable to provide a fluorescent ballast having improved starting properties so as to increase lamp life and maintain nominally rated lumen output for a longer period of time. The fluorescent ballast should substantially eliminate both current spikes produced by the one or more starting capacitors and the diversion of current by the one or more starting capacitors away from the one or more lamps once all lamps have been ignited.

SUMMARY OF THE INVENTION

Generally speaking, in accordance with the invention, a ballast for powering at least two lamp loads serially connected together includes a supply for producing an a.c. voltage, a sensing device for sensing when the a.c. voltage has reached a predetermined or greater level of a.c. voltage, a shunt device for shunting at least one lamp load and a switching device responsive to the sensing device for controlling when shunting by the shunt device of the at least one lamp loads occurs.

Preferably, the shunt device includes a capacitor, the sensing device is a bilateral electronic switch and the switching device includes an optocoupler. The lamp loads are typically of the fluorescent type. The switching device by controlling when the shunt device (e.g. capacitor) shunts at least one of the lamp loads avoids generation of current spikes normally associated with use of a capacitive shunting device. Shunting by the shunt device is discontinued by the switching device whenever the sensing device senses a voltage less than the predetermined level of the a.c. voltage. The predetermined level is generally chosen to be at least just above the voltage across all lamp loads following ignition of the latter. Drawbacks associated with the generation of current spikes, including reduced lamp life and reduced lumen output, are therefore avoided in accordance with the invention.

Preferably, the shunt device and switching device are serially connected across all but one of the lamp loads. Each of the lamp loads includes filaments. In accordance with a feature of the invention, additional switching responsive to the switching device controls when preconditioning of the filaments for starting of the lamp loads takes place. Shunting by the shunting device and preconditioning by the additional switching preferably occur at the same time.

In accordance with another aspect of the invention, a method for ballasting at least two lamp loads serially connected together includes the steps of producing an a.c. voltage, sensing when the a.c. voltage reaches at least a predetermined level and shunting at least one of the lamp loads only when the predetermined or greater level of a.c. voltage is sensed. Removal of such shunting occurs whenever a level of the a.c. voltage is less than the predetermined level.

Accordingly, it is an object of the invention to provide an improved fluorescent lamp ballast scheme which increases lamp life.

It is another object of the invention to provide an improved fluorescent lamp ballast scheme which minimizes the generation of current spikes.

It is a further object of the invention to provide an improved starting capacitor disconnect scheme for a fluorescent lamp ballast which effectively removes the starting capacitor from the ballast once all of the lamps have been ignited.

It is yet another object of the invention to provide an improved ballast scheme for serially connected fluorescent lamps which increases the lumen output of those lamps shunted by a starting capacitor.

Still other objects and advantages of the invention will, in part, be obvious, and will, in part, be apparent from the specification.

The invention accordingly comprises several steps and the relation of one or more such steps with respect to each of the others, and the device embodying features of construction, combination of elements and arrangements of parts which are adapted to effect such steps, all as exemplified in the following detailed disclosure, and the scope of the invention will be indicated in the claims

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENTS

Figure 1:
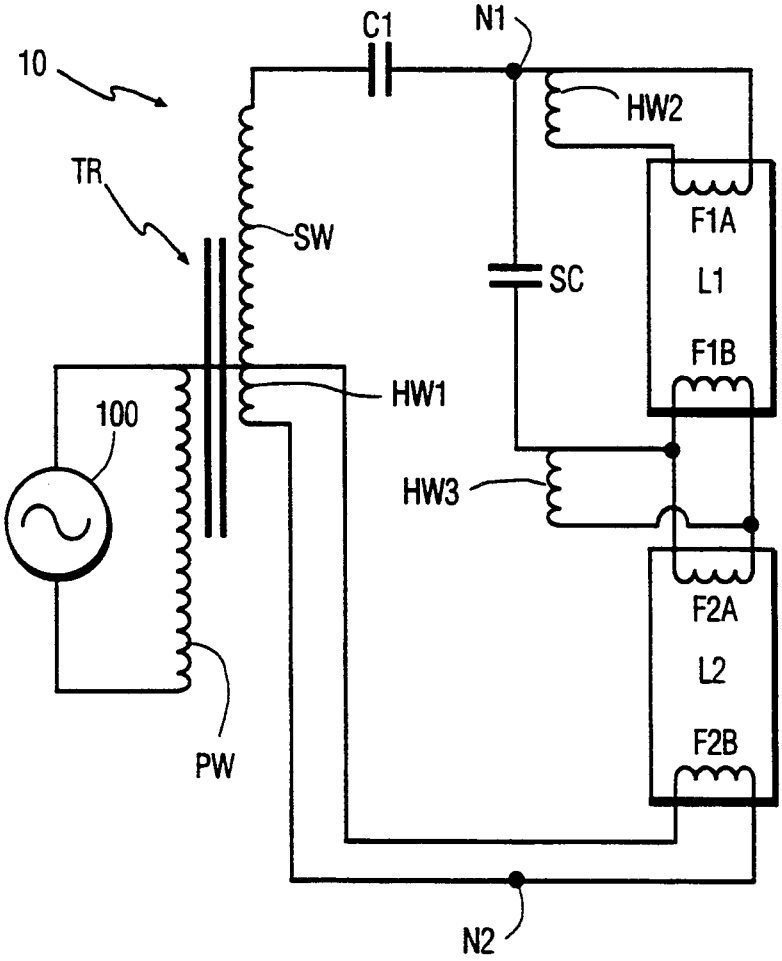
FIG. 1 PRIOR ART
FIG. 1 is a conventional ballast for ballasting serially connected lamp loads.

As shown in FIG. 1, a conventional ballast 10 for powering serially connected lamp loads L1 and L2 includes an a.c. voltage source 100 (i.e. a ballast inverter) connected to a primary winding PW of a transformer TR. Transformer TR also includes a secondary winding SW and three heater windings HW1, HW2 and HW3. Connected to one end of secondary winding SW is a capacitor C1 and at its other end are primary winding PW, heater winding HW1 and a filament F2B of lamp load L2. Connected to a node N1 are capacitor C1, a starting capacitor SC, heater winding HW2 and a filament F1A of lamp load L1.

Heater winding HW2 is connected across filament F1A. Heater winding HW1 is connected across filament F2B with a node N2 intermediate the connection joining one end of heater winding HW1 to one end of filament F2B. Heater winding HW3 is connected across a pair of filaments F1B and F2A of lamp loads L1 and L2, respectively. Starting capacitor SC is connected to the junction joining heater winding HW3 and filament F1B and F2A together.

Operation of ballast 10 is as follows: An a.c. voltage produced by source 100 is transformed by transformer TR so as to produce a stepped-up voltage across secondary winding SW. Capacitor C1, which is in series with secondary winding SW, serves as the primary ballast impedance for limiting current through lamp loads L1 and L2. Capacitor C1 also serves for power factor correction of ballast 10.

Prior to ignition of lamp load L2, each of heater windings HW1, HW2 and HW3 provides current for heating and thereby preconditioning the filaments of lamp loads L1 and L2. More particularly, heater winding HW1 provides a current for heating and thereby preconditioning filament F2B for starting lamp load L2. Heater winding HW2 produces a current which flows into and thereby preconditions filament F1A for starting lamp load L1. Heater winding HW3 provides the current for heating and thereby preconditioning filaments F1B and F2A for starting lamp loads L1 and L2, respectively.

Once lamp loads L1 and L2 have been preheated (i.e. preconditioned) by heater windings HW1, HW2 and HW3, the voltage between nodes N1 and N2 less the voltage drop of starting capacitor SC is applied to lamp load L2. More particularly, starting capacitor SC shunts lamp load L1 so that the voltage between nodes N1 and N2 less the starting capacitor SC voltage drop is applied directly between filaments F2A and F2B of lamp load L2 for starting (igniting) of the latter. Lamp load L2 enters its glow stage. The voltage across nodes N1 and N2 less the voltage drop across lamp load L2 now appears across starting capacitor SC and lamp load L1 and is sufficient for igniting the latter.

Figure 2:
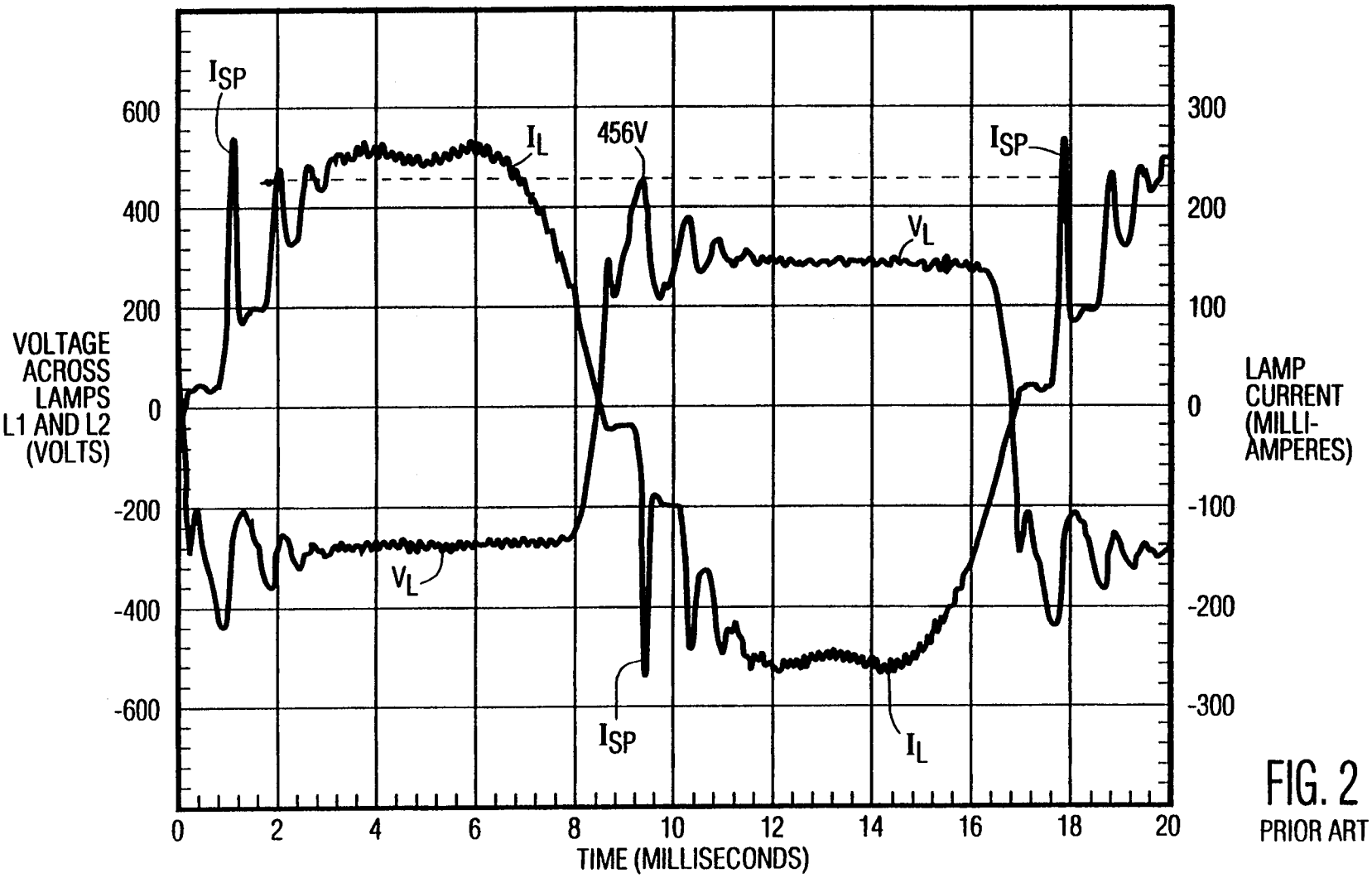
FIG. 2 PRIOR ART
FIG. 2 graphically illustrates lamp voltage and lamp current versus time for the ballast of FIG. 1.

FIG. 2 illustrates a current $I_L$ flowing through lamp loads L1 and L2 and a voltage $V_L$ across lamp loads L1 and L2 during steady state operation of lamp loads L1 and L2. During each ignition cycle of lamp loads L1 and L2, current spikes associated with starting capacitor SC appear. The most pronounced current spike during each ignition cycle of lamp loads L1 and L2 has been identified in FIG. 2 as $I_{SP}$. The values for voltage $V_L$ and current $I_L$ are based on generating approximately 300 volts RMS (i.e. approximately 450 volts peak) across nodes N1 and N2 prior to ignition of lamp loads L1 and L2. Lamp loads L1 and L2 are each 4 ft., 32 watt, T8 type fluorescent lamps.

The current spikes during each ignition cycle of lamp loads L1 and L2 are considered by lamp manufacturers to adversely affect lamp life by more rapidly depleting the emissive material from the lamp filament. The more emissive material which is sputtered onto the inner walls of the lamp also decreases the amount of light which is produced by the lamp.

Figure 3:
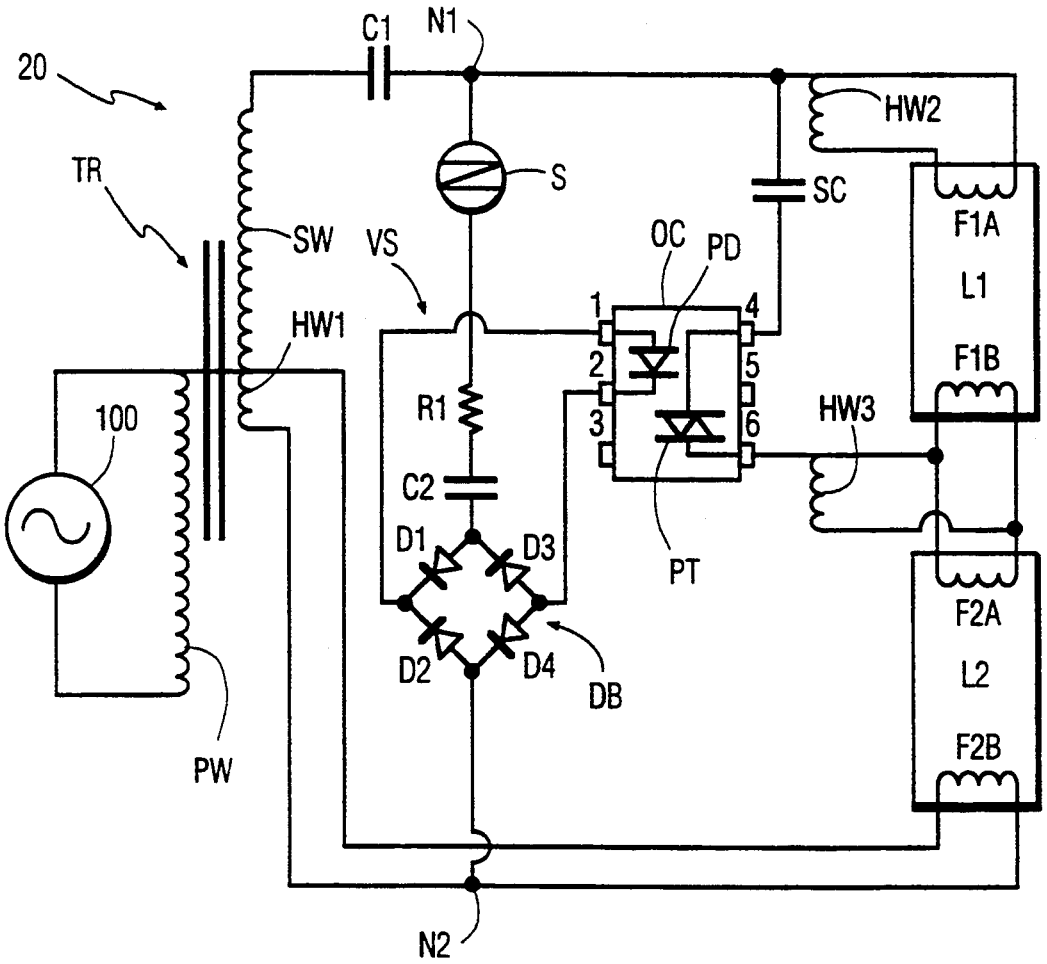
FIG. 3 is a ballast for ballasting serially connected lamp loads in accordance with one embodiment of the invention.

As shown in FIG. 3, a ballast 20 in accordance with a first embodiment of the invention is connected to lamp loads L1 and L2. Lamp loads L1 and L2 are serially connected together. Similar to ballast 10, an a.c. voltage produced by a.c. source 100 is connected across primary winding PW of transformer TR. Secondary winding SW increases the a.c. voltage to levels necessary for starting and then operating under steady state conditions lamp loads L1 and L2.

Connected at one end of secondary winding SW is capacitor C1. Secondary winding SW is also connected to a junction joining heater winding HW1, primary winding PW and filament F2B of lamp load L2 together. The other end of capacitor C1 is connected to a node N1 joining a SIDAC S, starting capacitor SC, heater winding HW2 and filament F1A of lamp load L1 together.

Connected to the other end of SIDAC S is a resistor R1. A capacitor C2 is connected between resistor R1 and a junction joining an anode of a diode D1 and a cathode of a diode D3 together. Diodes D1 and D3 are part of a diode bridge DB which also includes a pair of diodes D2 and D4. An anode of diode D2 and a cathode of diode D4 are connected to a junction joining heater winding HW1 and filament F2B together. SIDAC S, resistor R1, capacitor C2 and diode bridge DB form a voltage sensing circuit VS. Voltage sensing circuit VS is directly across the output of ballast 20, that is, connected to nodes N1 and N2. Heater windings HW1 and HW2 are connected across filaments F1A and F2B, respectively. Heater winding HW3 is connected to the junctions joining filaments F1B and F2A together.

An optocoupler OC has a plurality of pins 1-6. Connected between pins 1 and 3 is a photodiode PD. Connected between pins 4 and 6 is a phototriac PT. Pin 2 of optocoupler OC is connected to the junction joining the anodes of diodes D3 and D4 together. Pin 1 of optocoupler OC is connected to the junction joining the cathodes of diodes D1 and D2 together. Pin 4 of optocoupler OC is connected to starting capacitor SC. Pin 6 of optocoupler OC is connected to the junction joining heater winding HW3 and filaments F1B and F2A together.

Operation of ballast 20 is as follows. An a.c. voltage produced by voltage source 100 is applied to primary winding PW which induces a voltage in secondary winding SW and in heater windings HW1, HW2 and HW3. Similar to ballast 10, capacitor C1 serves as the primary ballast impedance for limiting current flow through lamp loads L1 and L2 and for power factor correction of ballast 20.

SIDAC S is a bilateral electronic device which switches to a conductive state when a predetermined (threshold/breakdown) voltage is reached and remains in a non-conductive (i.e. open state) below this breakdown voltage. Resistor R1 is selected for limiting the current flowing through voltage sensing circuit VS. Capacitor C2 serves to filter extraneous signals (typically above 60 hertz) flowing through SIDAC S. Consequently, the breakdown voltage of SIDAC S must be maintained for more than a few microseconds before SIDAC S is turned ON.

Prior to ignition of lamp loads L1 and L2, ballast 20 is in an open circuit condition, that is, an open circuit voltage appears across voltage sensing circuit VS between nodes N1 and N2. This open circuit voltage is at or above the breakdown voltage of SIDAC S.

The open circuit voltage between nodes N1 and N2 triggers SIDAC S into its conductive state allowing current to flow through the voltage sensing circuit VS. More particularly, current will flow during each ignition cycle of lamp loads L1 and L2 along a path which includes SIDAC S, resistor R1, capacitor C2, diode D1, photodiode PD of optocoupler OC and diode D4 or along a path which includes diode D2, photodiode PD, diode D3, capacitor C2, resistor R1 and SIDAC S.

Photodiode PD and phototriac PT are optically coupled together. Consequently, current flowing through photodiode PD triggers phototriac PT into its conductive state. Starting capacitor SC in combination with phototriac PT serves as a shunt across lamp load L1. The open circuit voltage between nodes N1 and N2 now appears across lamp load L2 (i.e. between filament F2A and F2B) and is sufficient to ignite lamp load L2.

Prior to ignition of lamp load L2, each of the heater windings HW1, HW2 and HW3 provides preconditioning current to the filaments of lamp loads L1 and L2. More particularly, heater winding HW1 provides current for heating and thereby preconditioning filament F2B for starting lamp load L2. Heater winding HW2 produces current which flows into and thereby preconditions filament F1A for starting of lamp load L1. Heater winding HW3 provides current for heating and thereby preconditioning filaments F1B and F2A for starting lamp loads L1 and L2, respectively.

Once lamp load L2 has been ignited, the voltage appearing across filaments F1A and F1B of lamp load L1 is approximately equal to the voltage between nodes N1 and N2 less the voltage drop across lamp load L2, the latter of which has entered its glow stage. The voltage across lamp load L1 now is sufficient for ignition of lamp load L1.

Once both lamp loads L1 and L2 have been started, the voltage between nodes N1 and N2 falls below the breakdown voltage of SIDAC S. SIDAC S now switches to its non-conductive state. Current no longer flows through photodiode PD of optocoupler OC. Light is no longer emitted by photodiode PD resulting in phototriac PT switching to its non-conductive state. Starting capacitor SC in combination with phototriac PT no longer shunts lamp load L1. Starting capacitor SC is effectively removed from across lamp load L1.

Figure 4:
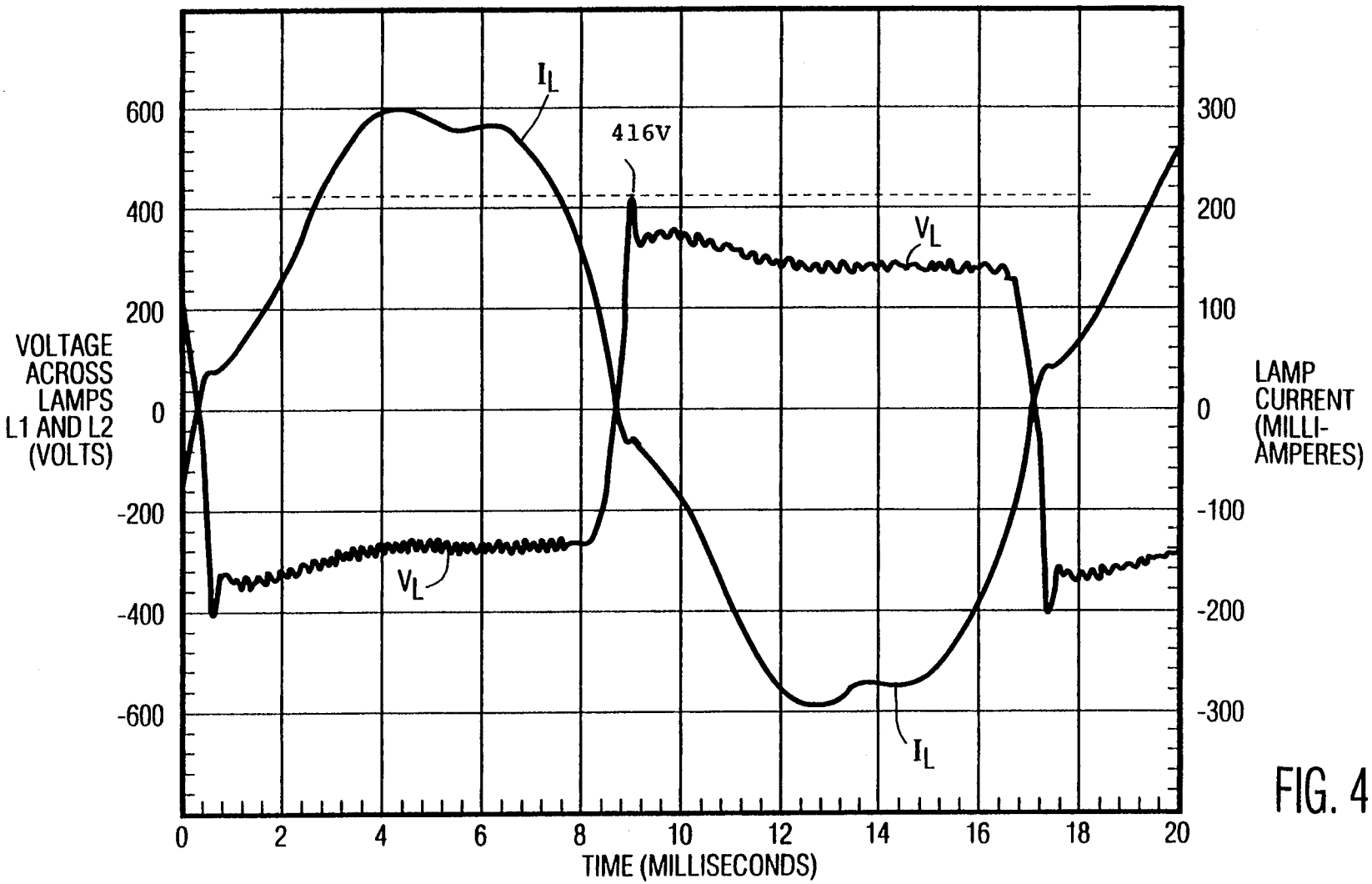
FIG. 4 graphically illustrates lamp voltage and lamp current versus time for the ballast of FIG. 3.

FIG. 4 illustrates lamp current $I_L$ flowing through and voltage $V_L$ between lamps L1 and L2 during steady state operation of ballast 20. In particular, substantially no current spikes appear during each ignition cycle of lamp loads L1 and L2. By substantially eliminating current spikes, such as spikes $I_{SP}$ as shown in FIG. 2, far less sputtering of filament emissive materials occurs during each ignition cycle. Consequently, lamp life is increased. The nominally rated lumen output of each lamp is maintained for a longer period of time. There is also no path provided by starting capacitor SC for diverting current away from lamp load L1 during steady state lamp operation. More light is therefore produced by lamp load L1 once the latter has been ignited by removing the shunt path of starting capacitor SC and phototriac PT from across lamp load L1.

In comparing FIGS. 2 and 4, it is also apparent that a higher voltage is required to maintain lamp load L1 and L2 lit (i.e. higher re-ignition voltage required to maintain lamp arc). More particularly, the voltage between nodes N1 and N2 required for re-ignition of lamp loads L1 and L2 based on the ballast scheme of FIG. 2 requires a peak voltage of approximately 456 volts as compared to only about 416 volts in FIG. 4.

Figure 5:
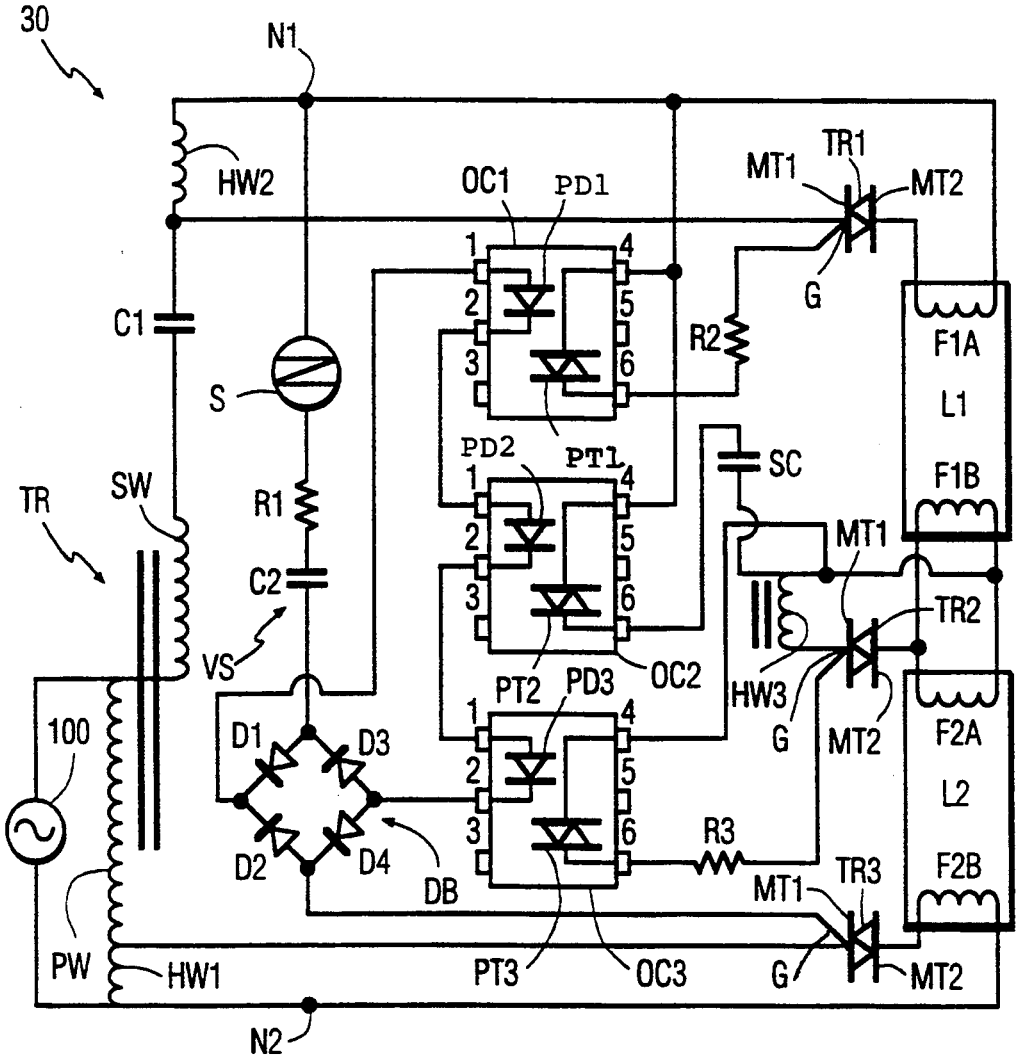
FIG. 5 is a ballast for ballasting serially connected lamp loads in accordance with an alternate embodiment of the invention.

In accordance with an alternate embodiment of the invention, FIG. 5 shows a ballast 30 which incorporates the starting capacitor disconnect scheme of ballast 20 with a filament disconnect scheme. Ballast 30 includes many of the same elements as ballast 20. Those elements of ballast 30 similar in construction and operation to corresponding elements of ballast 20 have been identified by like reference numerals and will not be further discussed herein.

Unlike ballast 20, ballast 30 includes three triacs TR1, TR2 and TR3. Each of these triacs has main terminals MT1 and MT2 and a gate G. Ballast 30 also includes three optocouplers OC1, OC2 and OC3. Each of these optocouplers includes six pins (1–6). Between pins 1 and 2 of optocouplers OC1, OC2 and OC3 is a photodiode PD1, PD2 and PD3, respectively. Between pins 4 and 6 of optocouplers OC1, OC2 and OC3 is a phototriac PT1, PT2 and PT3, respectively.

Main terminal MT1 of triac TR1 is connected to the junction joining together capacitor C1 and heater winding HW2. The main terminal MT2 of triac TR1 is connected to filament F1A of lamp load L1. SIDAC S is connected to a node N1 joining heater winding HW2, pins 4 of optocouplers OC1 and OC2 and filament F1A of lamp load L1. A current limiting resistor R2 is connected between pin 6 of optocoupler OC1 and gate G of triac TR1.

Starting capacitor SC is connected between pin 6 of optocoupler OC2 and the junction joining pin 4 of optocoupler OC3, heater winding HW3 and filaments F1B and F2A together. Main terminal MT2 of triac TR2 is connected to the junction joining filaments F1B and F2A together. Main terminal MT1 of triac TR2 is connected to heater winding HW3. A current limiting resistor R3 is connected between pin 6 of optocoupler OC3 and gate G of triac TR2.

Main terminal MT2 of triac TR3 is connected to filament F2B. Heater winding HW1 is connected at one end through node N2 to filament F2B and directly to a.c. source 100 and at its other end to primary winding PW and main terminal MT1 of triac TR3. Gate G of triac TR3 is connected to the junction joining the anode of diode D2 and the cathode of diode D4 together. Pin 1 of optocoupler OC1 is connected to the junction joining the cathodes of diodes D1 and D2 together. The junction joining the anodes of diodes D3 and D4 is connected to pin 2 of optocoupler OC3. Pin 2 of optocoupler OC1 is connected to pin 1 of optocoupler OC2. Similarly, pin 2 of optocoupler OC2 is connected to pin 1 of optocoupler OC3.

Operation of ballast 30 is as follows. The a.c. voltage produced by source 100 is applied across the series combination of primary winding PW and heater winding HW1. The voltage produced by a.c. source 100 is transformed and stepped-up by transformer TR. Prior to ignition of lamps L1 and L2, the open circuit voltage between nodes N1 and N2 is sufficient to turn ON (i.e. switch to its conductive state) SIDAC S. Current now flows through photodiodes PD1, PD2 and PD3 of optocouplers OC1, OC2 and OC3, respectively. The light emitted by these photodiodes turns on corresponding phototriacs PT1, PT2 and PT3 so as to place starting capacitor SC across lamp load L1. That is, starting capacitor SC in combination with phototriac PT2 shunts lamp load L1. At the same time current flows into the gates G of triacs TR1, TR2 and TR3 so as to turn ON each of these triacs. With triacs TR1, TR2 and TR3 switched to their conductive states, heater windings HW1, HW2 and HW3 supply current for preconditioning the filaments of lamp loads L1 and L2.

Starting capacitor SC, by shunting lamp load L1, permits sufficient voltage to be applied across lamp load L2 for ignition of the latter. Lamp load L1 is then ignited after lamp load L2. The voltage across SIDAC S following ignition of both lamp loads L1 and L2 drops below the breakdown level of SIDAC S. SIDAC S now switches to its non-conductive state. Current no longer flows through photodiodes PD1, PD2 and PD3. Phototriacs PT1, PT2 and PT3 turn OFF. Starting capacitor SC is effectively removed from ballast 30, that is, no longer shunts lamp load L1. At the same time, triacs TR1, TR2 and TR3 are turned OFF. Current for preconditioning the filaments of lamp loads L1 and L2 is therefore discontinued.

Effectively removing starting capacitor SC from ballast 30 once both lamps loads L1 and L2 have been ignited substantially eliminates current spikes from the lamp current $I_L$. An increase in lamp life and the period of time that the nominally rated lumen output of each lamp load is maintained results. Diverting current away from lamp load L1 by starting capacitor SC is also avoided. There is also a lower reignition voltage which is required as explained heretofore. At the same time that the starting capacitor is effectively removed from ballast 30, filament heating is discontinued. Energy consumption is therefore decreased while further increasing lamp life by no longer continuously heating filaments following ignition of lamp loads L1 and L2.

The current and voltage waveforms of FIG. 4 are based on a.c. source 100 producing a substantially sinusoidal waveform. Transformer TR is of the autotransformer type having a turns ratio of about 2.5:1. Capacitor C1 has a rating of 1.75 microfarads, 300 volts. SIDAC S has an approximately 300 volt breakover (i.e. threshold) voltage. Resistor R1 is selected to limit the current through diode bridge DB to a maximum level of about 25 milliamperes. Optocouplers OC of ballast 20 and OC2 of ballast 30 are made by Motorola Corp. of Schaumburg, Ill. under catalogue No. MOC3063. Optocouplers OC1 and OC3 of ballast 30 are made by Motorola Corp. under catalogue No. MOC3012. Lamp loads L1 and L2 are each 4 foot, 32 watt T8-type fluorescent lamps. Resistors R2 and R3 are chosen so as to limit the current flowing therethrough to a maximum level of approximately 10 milliamperes. Triacs TR1, TR2 and TR3 are available from Teccor Co. of Irving, Tex. under catalogue No. Q201E3.

As can be readily appreciated, the improved fluorescent lamp ballast schemes of FIGS. 3 and 5 as compared to the ballast scheme of FIG. 1 increase lamp life and maintain nominally rated lumen output for a longer period of time for those lamps across which starting capacitor SC is connected. In particular, ballasts 20 and 30 effectively remove starting capacitor SC therefrom once all lamp loads have been ignited. Generation of spike currents by starting capacitor SC during steady state operation of lamp loads L1 and L2 is substantially eliminated. As can also be readily appreciated, each of lamp loads L1 and L2 can include any combination of lamps and is shown, but not limited to, the series combination of two fluorescent lamps.

It will thus be seen that the objects set forth above, and those made apparent from the preceding description, are efficiently attained and, since certain changes may be made in the above construction without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A ballast for powering at least two discharge lamp loads serially connected together, comprising:
   - means for supplying an a.c. voltage to said at least two lamp loads;
   - means for sensing that the lamp voltage has reached a predetermined level of a.c. voltage;
   - shunt means for shunting at least one lamp load; and
   - switching means responsive to said sensing means for controlling when said shunt means shunts at least one of said lamp loads.

2. The ballast of claim 1, wherein said sensing means includes a bilateral electronic device.

3. The ballast of claim 1, wherein said switching means includes an optocoupler.

4. The ballast of claim 1, wherein said shunt means includes a capacitor.

5. The ballast of claim 1, wherein said lamps are of the fluorescent type.

6. The ballast of claim 1, wherein said shunt means and switching means are serially connected together across at least one of the lamp loads.

7. The ballast of claim 1, wherein each of said lamp loads includes filaments operable for preconditioning by said supply means, and further including additional switching means controlled by to said switching means for controlling when preconditioning of said filaments for starting of said lamps takes place.

8. The ballast of claim 7, wherein said switching means is further operable so that said shunt means shunt at least one of said lamp loads and at the same time said additional switching means provide preconditioning of said filaments by said supply means.

9. The ballast of claim 2, wherein each of said lamp loads includes filaments operable for preconditioning by said supply means and further including additional switching means responsive to said switching means for controlling when preconditioning of said filaments for starting of said lamps takes place.

10. The ballast of claim 6, wherein each of said lamp loads includes filaments operable for preconditioning by said supply means and further including additional switching means responsive to said switching means for controlling when preconditioning of said filaments for starting of said lamps takes place.

11. A method for ballasting at least two discharge lamp loads serially connected together, comprising:

supplying an a.c. voltage to said at least two serially connected discharge lamp loads;

sensing when the a.c. voltage supplied to at least one lamp load reaches at least a predetermined level; and shunting at least one lamp load with a shunt device only when said predetermined level of a.c. voltage is sensed.

12. The method of claim 11, further including removing said shunt device whenever a level of lamp a.c. voltage less than said predetermined level is sensed.

13. The method of claim 11, wherein said discharge lamp loads include filaments, and preconditioning said filaments only when shunting at least one lamp load with said shunt device.

14. A ballast apparatus for energizing a plurality of serially connected discharge lamps, said ballast apparatus comprising:

input terminals for supplying an AC voltage to said plurality of serially connected discharge lamps, a ballast impedance for coupling said input terminals to said plurality of serially connected discharge lamps, shunt means for providing a shunt circuit for at least one of said discharge lamps, means for sensing that lamp voltage has reached a predetermined level of AC voltage, and switching means responsive to said sensing means for controlling when said shunt means provides said shunt circuit for said at least one discharge lamp.

15. The ballast apparatus as claimed in claim 14 wherein said sensing means comprises a bilateral voltage threshold device connected in parallel with the plurality of discharge lamps and connected to the lamp side of said ballast impedance.

16. The ballast apparatus as claimed in claim 14 wherein said shunt circuit comprises a capacitor connected in series circuit with said switching means and with said series circuit coupled in parallel with at least one of said discharge lamps.

17. The ballast apparatus as claimed in claim 14 wherein said shunt circuit comprises a capacitor and said switching means comprises a bidirectional semiconductor switch, said capacitor and said semiconductor switch being connected in a series circuit coupled in parallel with at least one of said discharge lamps, and wherein said sensing means is coupled in parallel with at least one of said discharge lamps and is responsive to lamp voltage when the lamps are on to make said semiconductor switch non-conductive to thereby decouple the capacitor from said at least one discharge lamp, said sensing means being further responsive to said lamp voltage when the lamps are off to make said semiconductor switch conductive thereby to couple the capacitor in shunt circuit with said at least one discharge lamp.

18. The ballast apparatus as claimed in claim 14 wherein each of said discharge lamps includes heating filaments, said ballast apparatus further comprising:

further switching means coupled to said heating filaments and to said input terminals and controlled by said switching means to control the flow of a preconditioning heater current to said heating filaments.

19. The ballast apparatus as claimed in claim 18 wherein said shunt circuit comprises a capacitor, said switching means and said further switching means comprise first and second bi-directional semiconductor switches, respectively, and said capacitor and said first and second semiconductor switches are connected in a series circuit which is in shunt with at least one of said discharge lamps.

20. The ballast apparatus as claimed in claim 14 further comprising a step-up transformer having a primary winding coupled to said input terminals and a secondary winding coupled to said plurality of serially connected discharge lamps via said ballast impedance.

21. The ballast apparatus as claimed in claim 20 wherein said ballast impedance comprises a capacitor, said discharge lamps comprise fluorescent lamps, said shunt circuit includes a second capacitor, said switching means comprises a bi-directional switching device, and said sensing means comprises a SIDAC element.

22. The ballast apparatus as claimed in claim 14 wherein said ballast impedance is connected in series circuit with said discharge lamps to said input terminals, said sensing means comprises a bilateral voltage threshold device connected in a second series circuit with a resistor, a capacitor and a diode bridge circuit, said second series circuit being connected at one end to a node between said ballast impedance and a first lamp of said serially connected lamps and being connected at its other end to a node between a last lamp of said serially connected lamps and that one of the input terminals that is remote from the ballast impedance.

* * * * *